US007218876B2

(12) United States Patent
Federico et al.

(10) Patent No.: US 7,218,876 B2
(45) Date of Patent: May 15, 2007

(54) METHOD AND SYSTEM FOR IMPROVING THE THROUGHPUT OF A HIGH CAPACITY DOCUMENT PRINTER

(75) Inventors: Anthony M. Federico, Webster, NY (US); Dragana Pavlovic, Rochester, NY (US); John H. Conley, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 177 days.

(21) Appl. No.: 11/175,493

(22) Filed: Jul. 5, 2005

(65) Prior Publication Data

US 2007/0009276 A1 Jan. 11, 2007

(51) Int. Cl.
*G03G 15/00* (2006.01)

(52) U.S. Cl. ..... 399/81; 358/1.15; 399/8; 715/700

(58) Field of Classification Search ..... 399/81, 399/82, 43, 8; 358/1.15; 715/700, 771, 715/772

See application file for complete search history.

(56) References Cited

U.S. PATENT DOCUMENTS 4,587,532 A 5/1986 Asano
5,271,065 A 12/1993 Rourke et al.
5,343,304 A 8/1994 Nakal et al.
5,398,289 A 3/1995 Rourke et al.
5,422,705 A 6/1995 Omelchenko et al.
5,461,469 A 10/1995 Farrell et al.
5,469,533 A 11/1995 Dennis
5,600,762 A 2/1997 Salgado et al.
5,619,649 A 4/1997 Kovnat et al.
5,694,529 A 12/1997 Fromherz
5,717,841 A 2/1998 Farrell et al.
5,730,571 A 3/1998 Rinaudo
5,778,377 A 7/1998 Marlin et al.
5,790,119 A 8/1998 Skiut et al.
5,837,344 A 11/1998 Braun
5,859,711 A 1/1999 Barry et al.
5,876,555 A 3/1999 Hellsund et al.
5,978,559 A 11/1999 Quinion
6,549,299 B1 4/2003 Allen et al.
7,145,678 B2 * 12/2006 Simpson et al. ..... 358/1.15
2001/0055123 A1 12/2001 Ryan et al.
2006/0245780 A1 * 11/2006 Yamada ..... 399/81

* cited by examiner

*Primary Examiner*—Sophia S. Chen
(74) *Attorney, Agent, or Firm*—Michael J. Nickerson; Basch & Nickerson LLP

(57) ABSTRACT

Programming of the input and output paper handling setup of a high speed reprographic system can adversely affect the throughput of the system. A method or system includes a control system that examines the proposed setup and then determine if any of these options results in a loss of throughput. If such losses are detected and exceed a predetermined threshold, the operator of the device will be informed and given the opportunity to change the setup to reduce the throughput loss.

8 Claims, 3 Drawing Sheets

METHOD AND SYSTEM FOR IMPROVING THE THROUGHPUT OF A HIGH CAPACITY DOCUMENT PRINTER

BACKGROUND

High speed reprographic systems are well known and in common use throughout the business world. These systems contain many complex components which must work together to produce the desired output documents from the input source. These components can include digital front ends that accept electronic input and generate page images; a printing engine that accepts these page images and marks them on appropriate media; and one or more finishing devices that may fold, collate, staple or bind the pages together to make the final documents. Conventional control systems coordinate the operation of these separate components to ensure efficient usage of the machinery.

For example, conventional systems, such as disclosed in U.S. Pat. No. 5,461,469 and published US Patent Application US 2001/0055123A1, show an apparatus for programming and coordinating the task of assembling a complex document from its individual components, each of which may be produced by a separate machine, and are then further combined in a finishing apparatus. The entire contents of U.S. Pat. No. 5,461,469 and published US Patent Application US 2001/0055123A1 are hereby incorporated by reference.

However, conventional systems are aimed at coordinating and optimizing the assembly of the final document and not necessarily with the optimum usage of each individual component of the system. Very often, in reprographic engines that are part of a larger document preparation system, the details of optimum usage of the printing engine are often subsumed under the goal of properly assembling the complex document and ensuring that the proper work flow is followed.

Since the cost of complex document preparation systems is quite high, the goal of maximizing the throughput of the overall system has cost advantages to its users. To fully realize this throughput goal, it is necessary to not only optimize the interactions and flow between the individual elements of the document preparation system, but to also to optimize as much as possible the throughput of each individual component of the system. In order to do this one must know the precise details of the internal operation of the machine in question.

There are often cases in which the operator of a machine may not even be aware of inefficiencies that may arise when choosing certain options. In some cases, especially where the job is small, the overhead of alerting the operator of the inefficiency and suggesting a change may consume more time than simply executing the job. However, in many cases this is not true. In this case it would be desirable for the overall production system to be able to modify its setup instructions to better produce the job. However such a change may require other operator interventions, for example to load different paper stock to route the printing or finishing to a different machine than originally planned.

Even if the reprographic engine is operated as a stand-alone machine, the ability to optimize the setup of the machine can result in increased throughput which can result in economically significant savings.

In order to effectively use a printing engine, one must understand all of the details of its internal operation and the interactions between the various internal components.

For example, in many high speed printing engines, the internal operations are all keyed to the cycle of the photoreceptor. It is not reasonable to expect that an operator of such a machine to be knowledgeable at that level of detail.

It is therefore useful to provide a system that can automatically compute the optimum setup of a printing engine based on the detailed characteristics of the engine.

It is further desirable that such a system could also be programmed to have a library of common jobs associated with the machine so that it could more rapidly and automatically program itself.

A further desirable characteristic of such a compensation system is that it should make some estimate of the savings in time and effort involved in changing from an operator selected setup to an optimum one, and if the savings is below some threshold level, to forgo changing the setup or even notifying the operator, thereby avoiding changes that yield only a small benefit and where the effort involved in making the change is larger than the savings.

An aspect of such a compensation system would include a computational element that, given the input and output paper path options: compute the optimum time needed to produce the job, the extra time needed to produce the job, given the chosen setup, and a way to inform the operator of the system of any excess time needed.

A further aspect of such a compensation system would include inform the operator of the time penalty only if it exceeded some predetermined threshold.

A further aspect of such a compensation system would inform the operator of the system via the user interface.

A further aspect of such a compensation system would communicate the time penalty via an external communication interface, if that was the means of programming the job.

A further aspect of such a compensation system would be to use lookup tables based on the input and output configurations to simplify the logic and computation of the times involved.

BRIEF DESCRIPTION OF THE DRAWING

The drawings are only for purposes of illustrating an embodiment and is not to be construed as limiting, wherein.

DETAILED DESCRIPTION

Figure 1:
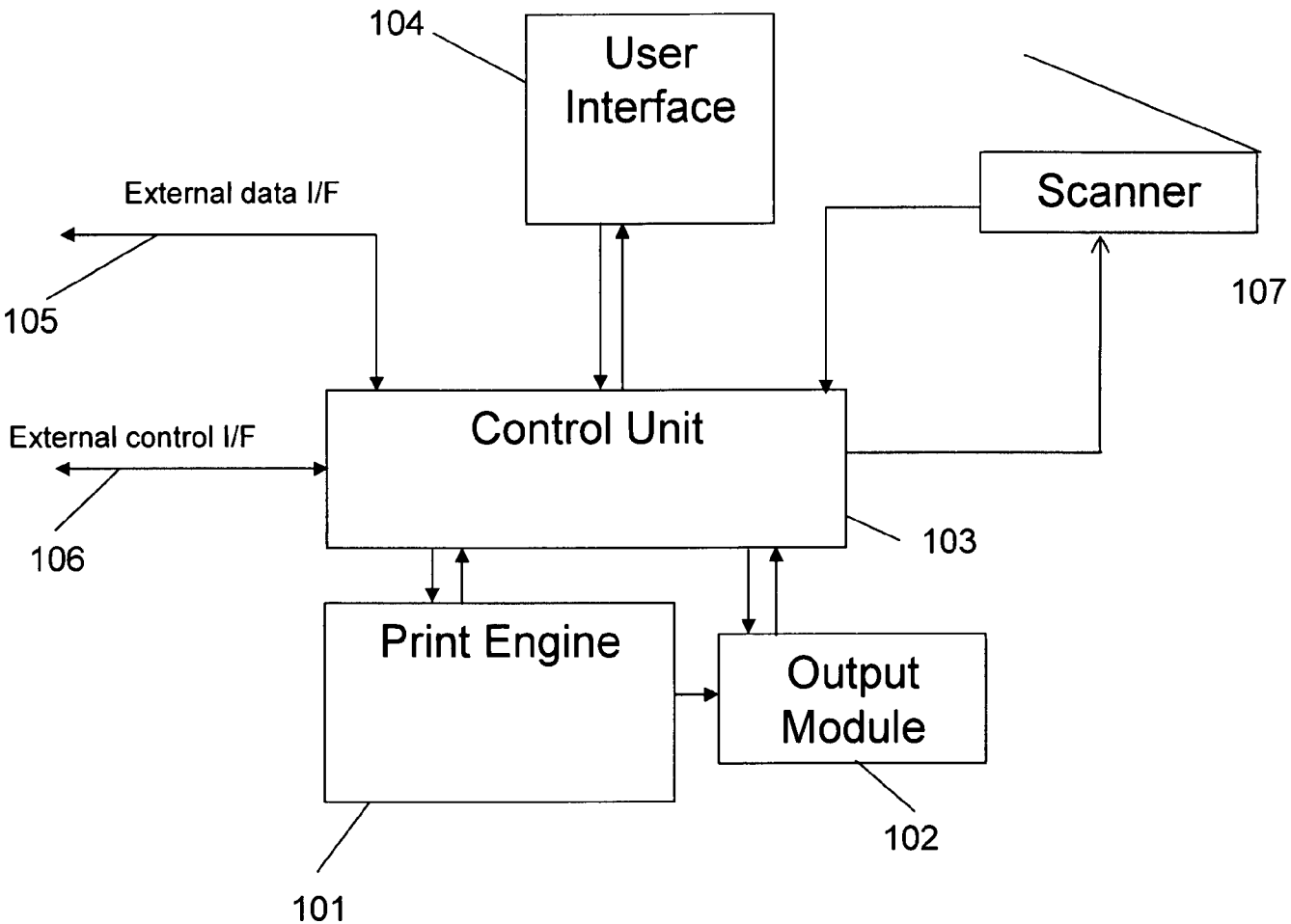
FIG. 1 is a block diagram of a conventional reprographic system.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

Referring to FIG. 1, FIG. 1 is a block diagram of a conventional reprographic system including a print engine 101. The print engine, 101, described in more detail below, contains various elements needed to place marks on the output media, usually paper.

The print engine 101 is closely coupled to an output module 102 that performs various finishing operations on output media. Examples of such operations might include sorting, collating, and stapling.

The reprographic system of FIG. 1 is controlled by a control unit 103. The control unit 103 connects to a User Interface 104 that allows the operator of the system to program it for the desired functions; e.g., number of copies and output finishing operations.

The control unit 103 may also connect to an external source of data 105 and an external source of control 106. These interfaces can be used to control the reprographic system and provide the reprographic system with data from a remote source or from other machines not integrally a part of the reprographic system. If the reprographic system is to be operated as a stand-alone copier it will be equipped with a document scanner 107, which is also controlled by the control unit 103.

Often the control unit 103 may include other functions not mentioned here. For example it may accept documents described in a Page Description Language, such as Postscript, and convert the documents into the data format needed to operate the printing unit. In some systems, the control unit 103 may accept preprocessed page images for printing. While these functions are familiar to those skilled in the art, these functions are not directly relevant to the present description and will not be further mentioned.

Figure 2:
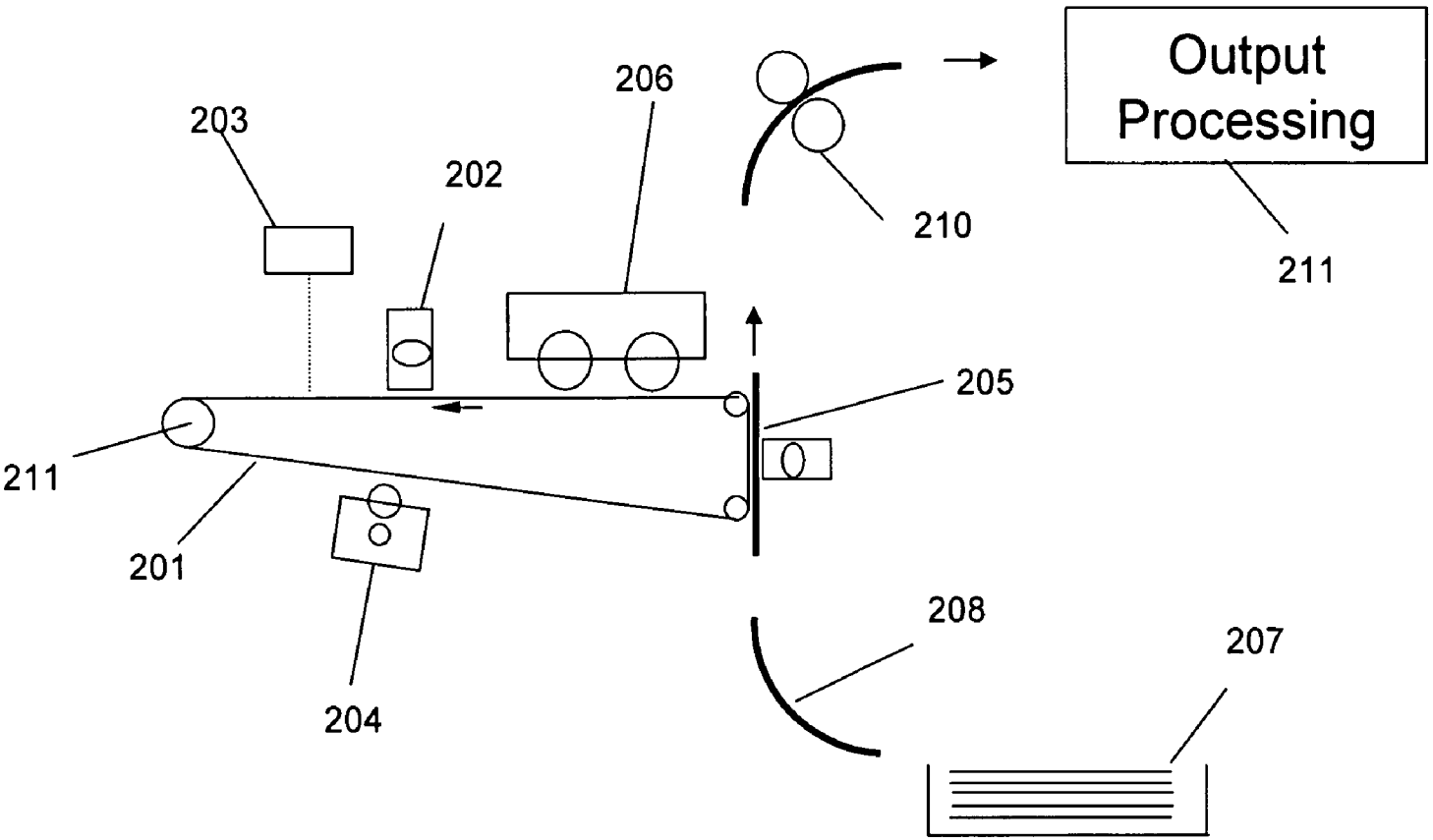
FIG. 2 is a schematic diagram of the internal components of a conventional reprographic engine.

Turning now to FIG. 2, FIG. 2 provides a schematic of the operation of a typical xerographic printing engine. As illustrated in FIG. 2, a key component is a photoreceptor belt 201, which is covered with a photosensitive insulating material. The photoreceptor belt 201 is driven in by a motor 211 in a counterclockwise direction. As the photoreceptor belt 201 passes through a charging station 202, the photoreceptor belt 201 is charged with by a corona discharge device.

The continued motion of the photoreceptor belt 201 takes it past an exposure region 203, where it is exposed to light of sufficient energy and intensity to discharge the belt due to photoelectric discharge wherever the light hits the belt. The light can come from an illumination and lens system imaging a physical original, or it may come from a scanned laser beam driven by an electronic system to produce the desired image.

The photoreceptor belt's 201 continuing motion takes it past a development station 204, where the remaining charged regions attract charged toner particles to the photoreceptor belt 201. At a transfer station 205, the toner particles are transferred to a piece of media. The residual toner on the photoreceptor belt 201 is removed in a cleaning station 206.

In conjunction with the photoreceptor belt 201, there is a media transport system or paper path that is synchronized to the photoreceptor belt's motion. Sheets of the media are taken from a tray 207 and positioned at a pre-transfer station 208. From the pre-transfer station 208, the media is moved through the transfer system 205 where various charging devices are used to electrostatically transfer the toner from the belt to the media. After the transfer station 205, the media with the attached toner is passed through a fuser 210, where the toner is fused, by heat, to the paper. After the fuser 210, the media is passed into an output processing module 211.

The media transport system in a reprographic engine may contain several different input trays. Each of these trays can contain media of different sizes, orientations, or composition. This combination allows for things like interposing cover sheets or dividers, or supplying transparent media for overhead projection.

The trays may also contain the media in different orientations, for example portrait and landscape modes. Since these trays are not usually all at the same distance from the transfer station, there may be a differential delay in moving a sheet of media from its input tray to the transfer station. This differential delay may result in a case where the photoreceptor has to skip an imaging cycle to allow the media to be properly positioned.

The output processing module may do many things with the media. For example, the output processing module may pass the media to a sorter for collation into multiple document sets. The output processing module may collect sheets of the media and staple or perform other finishing operations such as binding on the media. The output processing module may also include elements that can invert the paper, flipping the media from face up to face down. The output processing module may rotate the media from portrait to landscape orientation. As will be familiar to those skilled in the art, there may be many complex combinations of these elements and others as well.

As noted above, the paper path and the photoreceptor are operated in a synchronous manner. The operations are coordinated so that the media is presented to the transfer station only when the proper page image is present on the photoreceptor. Furthermore, because the paper path is essentially serial in nature, if there is any extra motion needed in the paper path, the photoreceptor must omit an imaging cycle. This is because the motion of the photoreceptor is continuous in nature, rather than a stop-start fashion. Therefore, if any extra time is needed by the paper path, the photoreceptor must synchronize by skipping an imaging phase.

It is common to refer to the concept of a photoreceptor pitch. This idea divides the photoreceptor surface into a series of spaces each of which corresponds to the length of photoreceptor needed to image a sheet of standard media. Often the standard media is the most common media size; in the US, it is 8.5"×11" paper.

The common assumption is that the paper is fed in landscape mode, the 8.5" dimension being along the direction of paper motion. If the media is fed in portrait mode, the 11" dimension being along the direction of motion, there is a longer time needed to perform the transfer operation and hence a lower throughput.

While there is no physical division of the photoreceptor, the conceptual division allows one to estimate the throughput impact of having to skip an imaging cycle, or to extend it to accommodate different orientation or paper size. If one has to skip an imaging cycle to allow for extra operations in the media path, the corresponding pitch on the photoreceptor is unused. Since there is a fixed number of pitches available for imaging in any given time period, the skipping of a pitch reduces the throughput of the printing engine because the photoreceptor is running at a constant speed.

One of the most common reasons that there might be a need for extra time in the paper path is for some extra processing that takes place in the output module. For example, the output processing module might be instructed to invert the media. For an inversion operation, the sheet of media must be turned over from face up to face down or vice versa. This operation often takes extra time, during which no further sheets of media can be passed down the paper path.

Another common need for extra time is the use of duplex printing. In this case, a sheet of media that has been printed on and passed through the fuser is flipped over and then passed back through the system to have information imaged on the reverse side. In some cases, it is possible to schedule the imaging so that the delay required to move the sheet around can be accommodated by changing the order of the page images that are processed. Such coordination is usually accomplished in the control unit.

However, there may be extra time needed in the duplex cycle if the time to invert the page and move it around to the transfer station is not an exact multiple of photoreceptor pitches.

The determination of the throughput efficiency of the reprographic engine is based upon how many imaging cycles the photoreceptor is capable of achieving. When every possible opportunity for an imaging cycle is taken, the reprographic system is operating at full throughput. If there is a need to omit one or more imaging cycles, the overall throughput of the engine is reduced by the fraction of imaging cycles that are omitted.

Thus, any operation in the paper path that requires any extra processing will require the omission of one or more imaging cycles and a corresponding reduction of throughput. Furthermore, to understand the actual throughput penalty requires a detailed understanding of the internal workings of both the xerographic and media path subsystems. This understanding is not normally part of the training of the operator of a typical reprographic system.

This understanding is further complicated by the fact that the operator of the reprographic system normally sets up any particular job by selecting the characteristics of the output, which essentially means the programming of the operations of the output processing unit. To fully understand the throughput implications of any particular job setup requires a detailed understanding of the output processing unit, the relative placement of the input trays and other complex factors.

Therefore, as noted above, it is desirable to include in the reprographic system functionality that would alert the operator of the system to any throughput penalties associated with any particular setup.

To realize this functionality, the parameters and rules for the paper path would be imbedded within a program module as part of the operating system that operates the control unit and its associated user interface.

For any particular output desired, the process would compute the theoretical maximum throughput for that output and compare it to the throughput that could be obtained by changing one or more of the output finishing operations.

For example, if the user programmed the output to be inverted, that is to be turned from face up to face down, the process would compute that there was a one pitch penalty for such an operation and inform the operator that the output could be obtained more quickly by omitting the inversion operation.

In other words, for each finishing option selected, the process would compute the number of extra photoreceptor pitches needed and from that compute the throughput penalty.

Moreover, the process may take into account several ameliorating steps. For example, if the user programs a job to use 11"×17" media instead of the standard 8.5"×11" media, the job would require twice as many photoreceptor pitches as the standard 8.5"×11" media job. While this is a loss in throughput compared to the standard media, it is not a loss of throughput compared to what this particular job requires and hence the correction for media size would not be used to compute any throughput loss.

On the other hand, if the request is for an inversion of the output, flipping the output page from face up to face down (requiring an extra photoreceptor pitch), this should be taken into account.

Thus, the process may take into account those factors that are actually relevant to the job in question and not just report any deviation from some standard job; i.e., single sided printing on 8.5"×11" media.

The process may also analyze other choices that can have throughput impacts. For example, if the print engine has more than one input tray, and there is a longer path for some trays than for others, the process can take this into account. This would allow for the full range of throughput limiting options to be considered.

The process may also compute the actual throughput loss in real time terms before notifying the operator of the machine. For example, on a short copying job, the time taken to inform the operator and have the operator make a change to the setup may exceed the lost time in producing the output according to the original choice. In such a case, it would be better to not inform the operator.

The process may also allow the users of the machine to specifically exclude certain operations from the computation. For example, if a particular organization regularly requires page inversion, it could enter a special setup routine when setting up the machine and indicate that page inversion was to be excluded from throughput calculations. Any such operation that is so marked would be excluded from any throughput computations as long as the setup remains unchanged.

The computation of the actual time is relatively straightforward. Since the machine speed is known, the operator has specified the size of the output (number of copies), and the machine also has a count of the number of pages to be printed for each copy; the time taken to produce the job at full speed and to further assess the throughput impact can be computed.

For example, If the number of pages to be printed is N, the number of copies is M, and the number of seconds corresponding to a single photoreceptor pitch is S, the shortest time needed to produce the desired output is given by N*M*S.

If the output setup requires P extra pitches per page, the actual output time will be increased by a time given by N*M*P*S (ExtraTime).

These two equations give the actual time needed to produce the job and the time penalty associated with the selected output options. As part of the computation, the process compares compare the ExtraTime to a predetermined threshold to decide if the operator should be notified. The predetermined threshold can be set to a default value at the factory with an option to allow the value to be changed in the field to accommodate each individual customer's preferences.

If the reprographic system is operated as part of a larger document preparation system, the setup information may not come from an operator via the user interface, but from a separate job manager via the Command and Control Interface 106 in FIG. 1. In this case, the reprographic system can be programmed to compute the throughput penalty for any given setup and then communicate this penalty via the Command and Control Interface to the external job manager. Such communication could include the specific elements of the setup that are responsible for the throughput penalty. The job manager can use this information to either modify the job setup or to accept the penalty. In the latter case, the job manager would simply send a message to the reprographic system to proceed with the setup as originally sent.

One way that the process can accomplish this would be to use one or more lookup tables. Each finishing operation would correspond to a lookup table entry wherein the entry would be the number of extra photoreceptor pitches needed for that finishing operation. Since the number of photoreceptor pitches depends on the size of the media being used, there would be a separate table for each possible paper size that the printing engine is equipped to handle.

Figure 3:
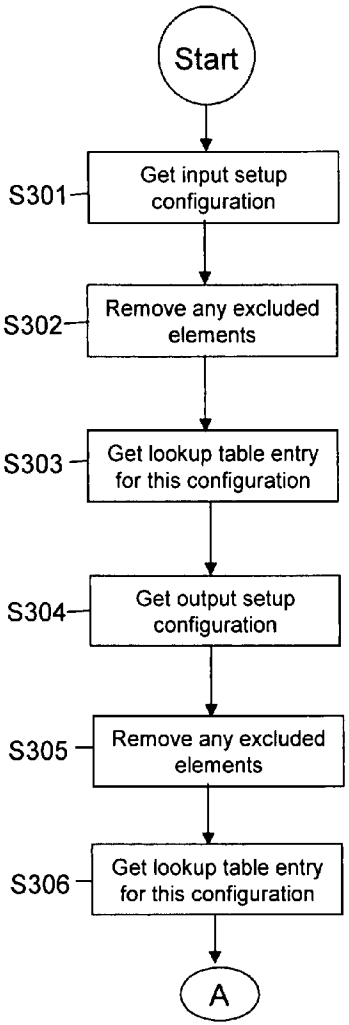
FIGS. 3–5 are flowcharts showing an automatic computation of an optimum setup of a printing engine based on detailed characteristics of a reprographic engine.
Figure 4:
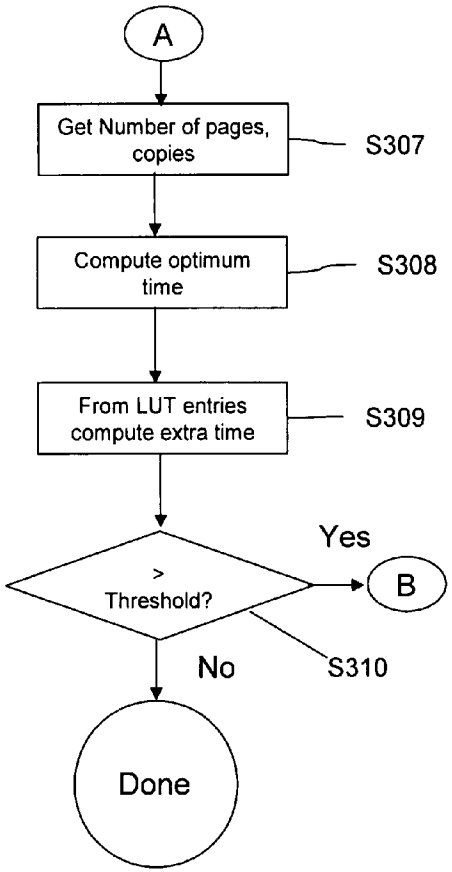
Figure 5:
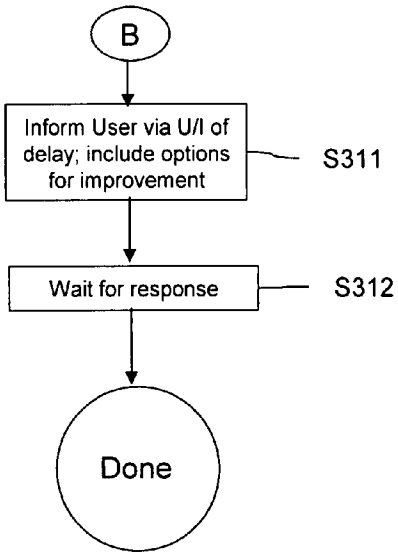

FIGS. 3–5 are flowcharts showing how the process may use these lookup tables to compute the throughput penalty.

At step S301, in FIG. 3, the process obtains, from an user interface, input configuration information. This information may include the particular tray, paper size, and paper orientation chosen.

From this configuration, the process, at step S302, first removes from consideration those input elements of the setup that are to be ignored. At step S303, the process may use a lookup table entry corresponding to the input configuration to obtain the maximum page rate for this paper size and also the extra time that is associated with the particular tray and orientation chosen. In many cases, the orientation can be found from the machine sensors which are monitoring the paper size and orientation that is currently true for a particular input tray.

At steps S304 through S306, the process would be repeated for the output configuration, using the lookup tables associated with the output configuration. These lookup table entries would include only the extra time needed to process the pages, given the input paper size chosen.

At step S307, in FIG. 3, the process gets the number of pages and number of copies of the document that is to be produced. At step S308, the optimum time to produce the job is computed using the equation described above. At step S309, the extra time is computed using the combined extra time entries from both the input and output lookup tables, using the equation described above. At step S310, the extra time is compared to the preset threshold time.

If the extra time is less than the threshold, the program is done and control returns to the other parts of the control unit to continue processing the job. However, if the extra time exceeds the preset threshold, the process proceeds to step S311 of FIG. 5 where a message is formed and sent to the user interface. This message would inform the operator of the extra time penalty, and also can offer suggestions on which elements of the job setup to change to reduce the time penalty. The process then proceeds to step S312 to wait for a response from the operator. The operator can choose to ignore the message and proceed or can modify the setup and then proceed.

It is noted that it has been assumed in the above descriptions that the reprographic system is a xerographic system, but the concepts are readily applicable to a liquid ink based system.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A reprographic system, comprising:

a control unit to control operations of the reprographic system;

a user interface to enable an operator to program a job;

a print engine to reproduce images in accordance with the programmed job; and a paper path to move media from an input station to said print engine and from said print engine to an output station;

said control unit computing an amount of time needed to process the programmed job;

said control unit computing a time needed to process a job similar to the programmed job; and said control unit, through said user interface, informing the operator of changes needed to the programmed job to reduce the time needed to produce the programmed job.

2. The system as claimed in claim 1, wherein said control unit, through said user interface, informing the operator of changes needed to the programmed job to reduce the time needed to produce the programmed job when a difference between the time needed to process a job similar to the programmed job and the time needed to process the programmed job exceeds a predetermined threshold.

3. The system as claimed in claim 1, wherein said user interface provides a message to the operator.

4. The system as claimed in claim 1, further comprising:

a remote programming unit to enable a remote operator to program a job;

said control unit, through said remote programming unit, informing the remote operator of changes needed to the programmed job to reduce the time needed to produce the programmed job.

5. The system as claimed in claim 1, wherein said control unit uses a lookup table based upon a job configuration to obtain parameters needed to compute the time values.

6. The system as claimed in claim 1, wherein said control unit exempts certain input or output configurations from the computation.

7. A method for controlling the operation of a reprographic system having a control unit to control operations of the reprographic system, a user interface to enable an operator to program a job, a print engine to reproduce images in accordance with the programmed job, and a paper path to move media from an input station to the print engine and from the print engine to an output station, comprising:

(a) computing an amount of time needed to process the programmed job;

(b) computing a time needed to process a job similar to the programmed job; and (c) informing the operator of changes needed to the programmed job to reduce the time needed to produce the programmed job.

8. The method as claimed in claim 7, wherein said informing the operator of changes needed to the programmed job to reduce the time needed to produce the programmed job occurs when a difference between the time needed to process a job similar to the programmed job and the time needed to process the programmed job exceeds a predetermined threshold.

* * * * *